United States Patent [19]

Beckley et al.

[11] 4,237,455

[45] Dec. 2, 1980

[54] IMPROVEMENTS IN SAFETY DEVICE FOR LIFTING MAGNETS

[75] Inventors: Philip Beckley, Newport; John Mildoon, Dudley, both of England

[73] Assignee: British Steel Corporation, London, England

[21] Appl. No.: 923,352

[22] Filed: Jul. 10, 1978

[51] Int. Cl.[3] ..... G08B 21/00; B66C 15/00

[52] U.S. Cl. ..... 340/685; 294/65.5; 340/540; 340/666; 340/668

[58] Field of Search ..... 340/685, 668, 666, 522, 340/540; 335/219, 285; 294/65.5

[56] References Cited

U.S. PATENT DOCUMENTS

| | | | |
|---|---|---|---|
| 3,638,211 | 1/1972 | Sanchez | 340/685 |
| 3,823,395 | 7/1974 | Rigney et al. | 340/685 |

*Primary Examiner*—Glen R. Swann, III

*Attorney, Agent, or Firm*—Bacon & Thomas

[57] ABSTRACT

A safety device for lifting magnet has sensor means responsive to flux produced by the device in the magnetic circuit including the body to be lifted, a transducer responsive to the lifting tension produced by the device together with a signal translation circuit effective to compare signals from the sensor and from the transducer and to provide an output indicative of a safety margin between lifting tension and the field available for lifting.

24 Claims, 3 Drawing Figures magnets 6, 8, of high coercive force, respectively, are secured to each pole piece so that adjacent like poles leave a central gap 10 for a moveable pole piece 12. Pole piece 12, also of low retentivity material, is slideably moveable along the gap in which a substantially zero magnetic field exists by virtue of the pole configuration adopted.

The lifting device is shown in FIG. 1(*a*) with a load 14 abutting the end faces of the pole pieces 2, 4. In this figure and with the position of the centre pole piece 12 as shown, magnetic equilibrium exists and no resultant field effective to produce a lifting force is produced.

To produce lifting, the centre pole 12 is as shown in FIG. 1(*b*) moved downwardly into contact with the load, conveniently by way of plunger 16. Movement of the centre pole into the position of FIG. 1(*b*) disturbs the equilibrium conditions which exist in the arrangement of FIG. 1(*a*) and produces a resultant field through load 14 for lifting.

Since the magnetic motive force of the ferrite magnets is substantially constant, the force exerted upon the load and available for lifting will depend upon the magnetic reluctance of the circuit which includes the pole pieces 2, 4, and the load 14. Reluctance will vary with the character of the load, i.e. with the packing density of a fully or partially particulate or laminated load, its magenetic permeability and also its shape. Reluctance will also depend upon the nature of the interface between the pole pieces 2, 4, and the load 14 and will be increased by any intermediate detritus which may be present.

To ensure that the vector magnetic field is sufficient to lift the applied load with sufficient safety margin, coil 18 is wound around the path of the moveable pole piece 12 adjacent the load. The coil 18 is responsive to the change in field strength produced by movement of the pole piece 12 from the position of FIG. 1(*a*) into the position of FIG. 1(*b*). The signal derived from the coil will be representative of the lifting field through the load along the axes of the pole pieces 2, 4. This signal is integrated and squared in integrator 20 shown in FIG. 2. Integrator 20 accordingly produces a signal indicative of the lifting force available along the pole piece axes. Compensating means (not shown) are applied so that the operation of current carrying coils (also not shown) to move the centre pole do not interfere with the accuracy of the output from the signal coil.

A load cell 22 which forms part of the shackle between the lifting device and the lifting wire, rope, chain or the like, delivers a signal which is a function of the weight of the load and which is applied to the combining amplifier 24. Combining amplifier 24 also receives signals derived from a device indicated generally at 30, which is capable of measuring the tilt of the lifting device to the vertical. Progressively increasing tilt will reduce the component of the magnetic force available for lifting and will progressively reduce the lifting safety margin available during lifting as shown in FIG. 2.

The tilting device 30 in this embodiment of the invention comprises a pendulum 32 supported for movement in mutually perpendicular vertical planes so as to be able to measure vector deviation from the vertical. The pendulum is coupled to two potentiometers (not shown) whose resistance or whose voltage output, as the case may be, is proportionate to the attitude of the pendulum and thereby of the lifting device in each of the two vertical planes.

Combining amplifier 24 is arranged to produce an output which is related to the extent by which tilt of the load affects the ratio of the load to the vector magnetic force available for lifting. The signal from the integrator 20, together with the output from the combining amplifier 24, are applied to a comparator 26 effective to produce an output when the force available for lifting is inadequate in relation to a selected safety margin.

The output from the comparator 26 is arranged to actuate a visual or an optical warning device 34 of a lift inhibiting device 36 which may operate continuously or intermittently. Such a visual warning device may comprise a flashing light which indicates unsafe lifting conditions.

It will be appreciated that while the invention has been described with reference to a lifting device employing permanent magnets, it is equally applicable to an electro-magnetic lifting device of conventional kind. It will also be appreciated that while the tilting device has been described as a pendulum coupled to potentiometers, a pendulum effective to actuate switches at selected angular displacements or the armature of a signalling differential transformer may be employed.

We claim:

1. A safety system for a magnetic lifting device comprising sensor means for producing a signal representative of flux produced by a device in the magnetic circuit including a body to be lifted, a transducer capable of producing a signal representative of the lifting tension applied to the device together with signal translation means arranged to receive signals derived from the sensor means and from the transducer and effective to provide an output indicating existence of a safety margin between lifting tension and the field available for lifting.

2. A safety system as claimed in claim 1 wherein the sensor means is responsive to the total magnetic flux produced by the device.

3. A safety device as claimed in claim 2 wherein the output of the signal translation means actuates a transponder when the computed safety margin falls below a predetermined level.

4. A safety system as claimed in claim 1 wherein the signal translation means is sensitive to the strength of the lifting field and lifting tension and operates to indicate a predetermined difference between said lifting field and lifting tension.

5. A safety device as claimed in claim 4 wherein the output of the signal translation means actuates a transponder when the computed safety margin falls below a predetermined level.

6. A safety device as claimed in claim 1, wherein the output of the signal translation means actuates a transponder when the computed safety margin falls below a predetermined level.

7. A safety device as claimed in any one of claims 1, 2, 4, 6, 3, or 5 wherein the output of the signal translation circuit operates a control system effective to inhibit lifting when the safety margin falls below a predetermined level.

8. A safety system as claimed in claim 7 wherein the signal translation circuit is responsive to a signal from means sensitive to the attitude of the magnetic lifting device.

9. A safety system as claimed in claim 8 wherein the attitude sensitive means is responsive to deviation of the lifting device from the vertical.

SAFETY DEVICE FOR LIFTING MAGNETS

FIELD OF THE INVENTION

This invention relates to magnetic lifting devices and is particularly, although not exclusively, concerned with lifting devices utilising permanent magnets.

Magnetic lifting devices, whether utilising permanent magnets or electro-magnets, have a lifting capacity which is dependent upon the nature of the body or matrix of bodies which are to be lifted. The nature of the body will determine the manner in which the magnetic field generated by the device extends into the body and the overall magnetic reluctance of the complete magnetic circuit including the body and the device. The inherent limit on the field strength which the permanent or electro-magnets can provide means that some bodies can be safely lifted while other apparently similar bodies producing a higher magnetic reluctance are too close to, or may exceed, lifting capacity. Potential failure to lift or to maintain lift presents considerable safety hazards, and it is one object of the present invention to reduce such hazards.

SUMMARY OF THE INVENTION

According to the broadest aspect of the present invention, a safety system for a magnetic lifting device comprises sensor means responsive to flux produced by the device in the magnetic circuit including the body to be lifted, a transducer responsive to the lifting tension produced by the device together with a signal translation circuit effective to compare signals from the sensor and from the transducer and to provide an output indicative of a safety margin between lifting tension and the field available for lifting.

According to a further aspect of the present invention, a magnetic lifting device incorporates means for sensing the magnitude of the flux in the magnetic circuit including the device and the body to be lifted, together with a transducer capable of measuring lifting tension so that a comparison between the field available for lifting and the lifting tension can be made and safety margin indicated from a previously established relationship. Preferably the sensor directly detects total flux in the magnetic circuit.

The magnetic circuit will contain air gap(s) between the lifting device and the load together with any air gaps within the body of the load in the case where there comprises sheets or laps of a coil or the like. Air gap(s) will reduce the total flux available for lifting and will accordingly reduce safety margins.

Suitably the field sensor and the lifting tension transducer generate signals which are compared to produce a signal representative of safety margin. This generally will be representative of the difference between the total load capability of the lifting device in relation to a given load configuration expressed in magnetic terms and the actual load sustained for the same given configuration. This difference represents an excess capacity of the device for a given configuration of the load over the actual requirement and this excess capacity may be further reduced artificially within the device at will so as to produce a pre-set safety factor expressed as a percentage of the weight of the load offered to the lifting device.

The signal representative of safety margin preferably is used to actuate an optical or acoustic transponder or other indicator or automatically inhibits the hoist mechanism. A suitable indicator is a warning light or buzzer arranged to operate when the safety margin falls below a selected level.

The comparison may be made by a suitable signal translation circuit sensitive to the outputs of the field sensor and the lifting tension transducer.

The transducer may be of any suitable type such as a conventional load cell well known in the art. Suitably the load cell is incorporated in a member which forms a shackle between the magnetic lifting device and the lifting wire, rope, chain or the like.

The field sensor suitably comprises a coil disposed to be intersected by the magnetic flux between the lifting device and the body attached for lifting. In the case of a magnetic lifting device of the type disclosed and claimed in UK Patents Nos. 1,272,488 and 1,218,754, in which a movable centre pole is effective to control the magnetic field produced by permanent magnets of opposed polarity, the sensing coil conveniently is disposed to surround the path of the centre pole adjacent the load. The coil will at the instant the flux from the magnet penetrates the load, produce a pulse which is representative of the flux through the load, and which can be applied to the signal translation circuit. The sensing coil may, however, be disposed to have a similar function according to the magnet design adopted.

It has been found that the safety margin of a magnetic lifting device is also dependent upon the attitude which it assumes during the lifting operation. Attitude will determine the vector component of the lifting field to the vertical and will progressively reduce the available lifting force as attitude or tilt increases.

According to a further aspect of the present invention, a magnetic lifting device incorporates means for sensing the deviation of a datum or point of reference on the device from the vertical and producing a signal representative of such deviation so that the field component available for lifting can be assessed.

Suitably the deviation sensor is capable of independently measuring tilt in each of two mutually perpendicular vertical planes. Conveniently the sensor comprises a suitably suspended pendulum or a capsule of dense liquid acting on pressure transducers or the like. Preferably the pendulum is arranged to actuate potentiometers producing signals representative of tilt in the two planes.

BRIEF DESCRIPTION OF THE DRAWINGS

An embodiment of the invention will now be particularly described by way of example with reference to the accompanying drawing in which.

DESCRIPTION OF PREFERRED EMBODIMENT

Figure 1A:
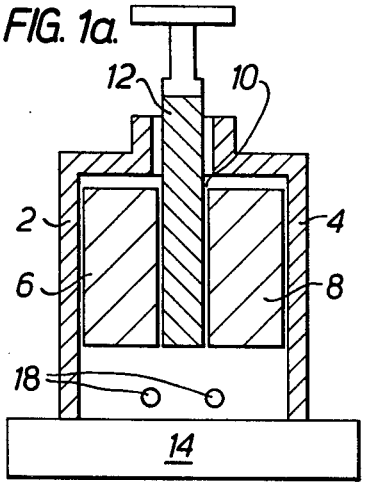
FIG. 1*a* is a sectional side view of a permanent magnet lifting device in accordance with the present invention showing the movable pole piece in the non-lifting position of the device.
Figure 1B:
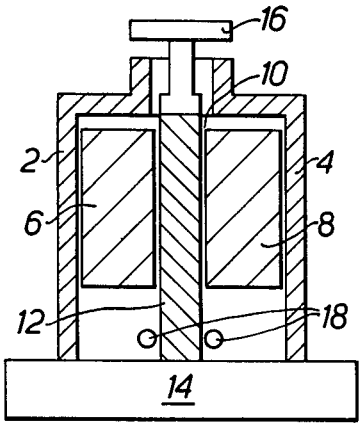
FIG. 1*b* is a sectional side view of the device of FIG. 1*a* showing the movable pole piece lowered to place the device in a work lifting mode.
Figure 2:
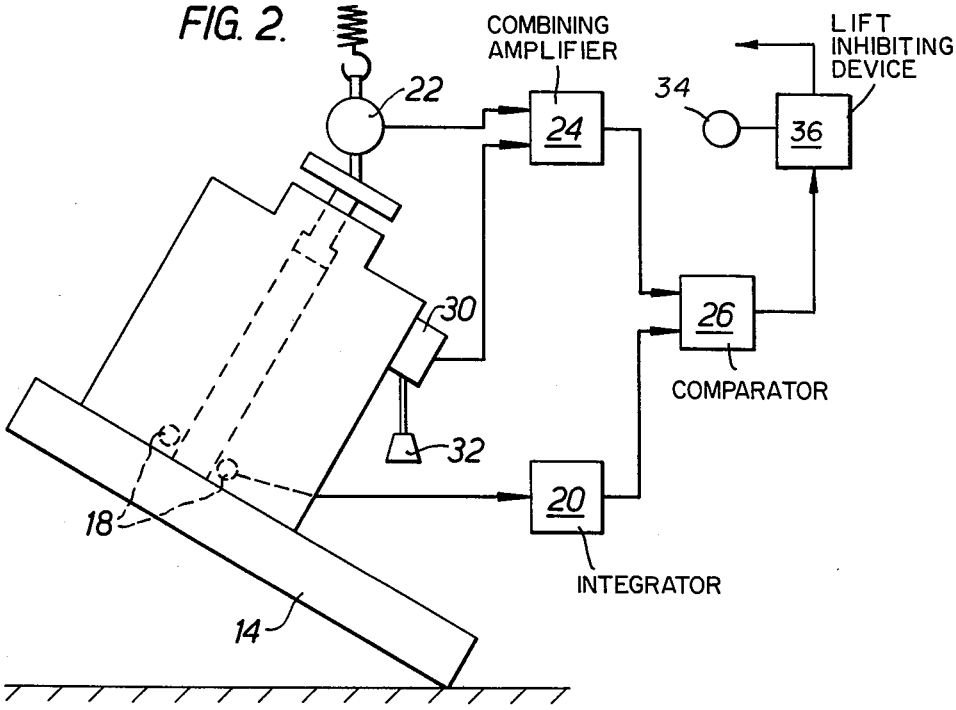
FIG. 2 is a schematic block diagram of a lifting device provided with the means according to the present invention for indicating safety margin during lifting.

Referring to FIG. 1, the permanent magnet lifting device comprises two outer fixed pole pieces 2, 4, of low retentivity material such as ductile iron. Ferrite 10. A safety system as claimed in claim 9 wherein the attitude sensitive means is responsive to deviation from the vertical in two mutually perpendicular planes.

11. A safety device as claimed in claim 10 wherein the attitude sensitive means include a pendulum connected to detectors effective to produce a signal representative of deviation from the vertical in mutually perpendicular planes.

12. A safety system as claimed in claim 11 wherein the detectors comprise potentiometers.

13. A safety system as claimed in claim 10 wherein the attitude means comprises a capsule of liquid acting on pressure transducers.

14. A safety system as claimed in claim 10 wherein the flux sensor means comprises a coil.

15. A safety device as claimed in claim 14 wherein the lifting device incorporates a movable pole piece for controlling flux and the coil is adapted to surround the movable pole.

16. A safety system as claimed in claim 15 wherein the lifting tension transducer comprises a load cell.

17. A safety system as claimed in claim 8 wherein the signal translation circuit includes an integrator operating on the signal derived from the flux sensor.

18. A safety system as claimed in claim 17 wherein a combining amplifier receives signals from the tension transducer and the integrator output.

19. A safety system as claimed in any one of claims 8 to 18 wherein the combining amplifier is responsive also to the signal from the attitude sensitive means.

20. A safety system as claimed in claim 19 wherein a comparator responsive to the output of the integrator and the combining amplifier is effective to operate a warning transponder or to operate a control system to inhibit lifting.

21. A magnetic lifting device incorporating the safety system as claimed in any one of claims 1, 2, 4, 6, 3, or 5.

22. A magnetic lifting device as claimed in claim 21 incorporating permanent magnets of high coercivity.

23. A magnetic lifting device as claimed in claim 22 wherein the permanent magnets are ferrite magnets.

24. A magnetic lifting device as claimed in claim 23 wherein the lifting device comprises a pair of permanent magnets having spaced like poles, a pole movable between the like poles for controlling lifting flux together with fixed pole pieces adapted to engage the body to be lifted co-operating with the other like poles.

* * * * *